US010145623B2

(12) United States Patent
Contet et al.

(10) Patent No.: US 10,145,623 B2
(45) Date of Patent: Dec. 4, 2018

(54) VEHICLE HEAT EXCHANGER TUBE AND VEHICLE RADIATOR COMPRISING SUCH A TUBE

(71) Applicant: TITANX HOLDING AB, Sölvesborg (SE)

(72) Inventors: Arnaud Contet, Sölvesborg (SE); Anders Brorsson, Sölvesborg (SE); Ulf Bergman, Kristianstad (SE)

(73) Assignee: TitanX Holding AB (SE)

( * ) Notice: Subject to any disclaimer, the term of this patent is extended or adjusted under 35 U.S.C. 154(b) by 0 days.

(21) Appl. No.: 15/305,972

(22) PCT Filed: Apr. 17, 2015

(86) PCT No.: PCT/SE2015/050444
§ 371 (c)(1),
(2) Date: Oct. 21, 2016

(87) PCT Pub. No.: WO2015/163808
PCT Pub. Date: Oct. 29, 2015

(65) Prior Publication Data

US 2017/0045305 A1 Feb. 16, 2017

(30) Foreign Application Priority Data

Apr. 22, 2014 (SE) ..... 1450474

(51) Int. Cl.
*F28F 1/02* (2006.01)
*F28D 1/053* (2006.01)
(Continued)

(52) U.S. Cl.
CPC ..... *F28F 1/022* (2013.01); *F28D 1/05366* (2013.01); *F28D 1/05383* (2013.01);
(Continued)

(58) Field of Classification Search
CPC ..... F28D 1/0316; F28D 1/05366; F28D 1/05388; F28D 2021/0094; F28F 1/02;
(Continued)

(56) References Cited

U.S. PATENT DOCUMENTS 4,692,979 A 9/1987 Pietzker
6,073,688 A * 6/2000 Kato ..... F28D 1/0316 165/173
(Continued)

FOREIGN PATENT DOCUMENTS

CN 101042283 A 9/2007
CN 101061362 A 10/2007
(Continued)

*Primary Examiner* — Len Tran
*Assistant Examiner* — Hans Weiland
(74) *Attorney, Agent, or Firm* — Condo Roccia Koptiw LLP

(57) ABSTRACT

A vehicle heat exchanger tube (2) comprises at least a first and a second separate fluid channel (14, 16). A tube stiffener (38) has a first stiffening portion (40) stiffening the first channel (14) of the tube (2), and a second stiffening portion (42) stiffening the second channel (16) of the tube (2). The first stiffening portion (40) comprises a first supporting surface (46) supporting the first larger surface (20) of the first channel (14), and a second supporting surface (48) supporting the second larger surface (22) of the first channel (14). The second stiffening portion (42) comprises a first supporting surface (56) supporting the first larger surface (26) of the second channel (16), and a second supporting surface (58) supporting the second larger surface (28) of the second channel (16).

12 Claims, 5 Drawing Sheets

(51) Int. Cl.
*F28D 21/00* (2006.01)
*F28F 3/04* (2006.01)
*F28D 1/03* (2006.01)

(52) U.S. Cl.
CPC ..... *F28F 1/02* (2013.01); *F28D 1/0316* (2013.01); *F28D 2021/0094* (2013.01); *F28F 3/042* (2013.01); *F28F 2001/027* (2013.01); *F28F 2225/04* (2013.01)

(58) Field of Classification Search
CPC .... F28F 1/022; F28F 1/025; F28F 1/04; F28F 1/08; F28F 1/40; F28F 1/42; F28F 3/042; F28F 3/044; F28F 3/046; F28F 2001/027; F28F 2225/04; Y10S 165/906
See application file for complete search history.

(56) References Cited

U.S. PATENT DOCUMENTS

| | | | | |
|---|---|---|---|---|
| 7,143,824 | B2 * | 12/2006 | Emrich | F28D 1/05383 165/178 |
| 7,461,685 | B2 * | 12/2008 | Overbury | F28D 1/05366 165/178 |
| 7,487,589 | B2 * | 2/2009 | Smith | F28F 3/025 165/173 |
| 8,261,816 | B2 | 9/2012 | Ambros et al. | |
| 2004/0182559 | A1 | 9/2004 | Kent et al. | |
| 2005/0161206 | A1 * | 7/2005 | Ambros | F28F 3/025 165/173 |
| 2005/0199379 | A1 | 9/2005 | Kimura et al. | |
| 2007/0131404 | A1 | 6/2007 | Overbury et al. | |
| 2009/0166020 | A1 | 7/2009 | Smith et al. | |
| 2012/0024510 | A1 * | 2/2012 | Kohl | F28D 1/05366 165/175 |
| 2014/0190675 | A1 * | 7/2014 | Denoual | F28D 1/035 165/181 |

FOREIGN PATENT DOCUMENTS

| | | | |
|---|---|---|---|
| CN | 103688123 | A | 3/2014 |
| DE | 27 47 275 | A1 | 4/1979 |
| EP | 0 176 729 | A1 | 4/1986 |
| EP | 0 632 245 | A1 | 1/1995 |
| EP | 1 022 532 | A2 | 7/2000 |
| EP | 1243884 | A2 | 9/2002 |
| EP | 1 408 298 | A2 | 4/2004 |
| EP | 1544564 | A1 | 6/2005 |
| WO | WO 2006/015029 | A2 | 2/2006 |
| WO | WO 2012/131038 | A1 | 10/2012 |
| WO | WO 2013/004759 | A1 | 1/2013 |

* cited by examiner

VEHICLE HEAT EXCHANGER TUBE AND VEHICLE RADIATOR COMPRISING SUCH A TUBE

CROSS REFERENCE TO RELATED APPLICATIONS

This application is the National Stage Entry under 35 U.S.C. § 371 of Patent Cooperation Treaty Application No. PCT/SE2015/050444, filed 17 Apr. 2015, which claims priority from Sweden Application No. 1450474-0, filed on 22 Apr. 2014, the contents of which are hereby incorporated by reference herein.

TECHNICAL FIELD OF THE INVENTION

The present invention relates to a vehicle heat exchanger tube comprising an internal reinforcement structure.

The present invention further relates to a vehicle radiator and to a method of forming a vehicle heat exchanger tube.

BACKGROUND OF THE INVENTION

A vehicle heat exchanger may typically comprise a number of tubes inside of which a hot fluid, such as engine cooling coolant, may be forwarded. On the outside of the tubes a cooling fluid, such as ambient air, may flow to exchange heat with the engine cooling coolant to cool the latter.

DE 27 47 275 A1 discloses a light metal heat exchanger for a vehicle. The heat exchanger comprises vehicle heat exchanger tubes for transporting a fluid under heat exchange with a heat exchange medium. Each tube is, at least at its respective end portion, provided with an internal reinforcement structure reinforcing the walls of the tube.

SUMMARY OF THE INVENTION

An object of the present invention is to provide a vehicle heat exchanger tube being reinforced in a manner more effective than that of the prior art.

This and other objects are achieved by means of a vehicle heat exchanger tube comprising an internal reinforcement structure, wherein the vehicle heat exchanger tube comprises at least a first and a second separate fluid channel extending along the tube and being parallel with each other and being separated from each other by at least one separating wall extending along at least a portion of the tube, each fluid channel having an inner height, measured in a direction being parallel with the height of the separating wall, which is smaller than its width, the first channel having a first large surface, and an opposing second large surface, the second channel having a first large surface, and an opposing second large surface, wherein the internal reinforcement structure is a tube stiffener having a first stiffening portion stiffening the first channel of the tube, and a second stiffening portion stiffening the second channel of the tube, wherein the first and second stiffening portions of the tube stiffener are joined to each other at a joining portion, wherein the first stiffening portion comprises a first supporting surface supporting the first larger surface of the first channel, a second supporting surface supporting the second larger surface of the first channel, and an intermediate portion connecting the first supporting surface to the second supporting surface, and wherein the second stiffening portion comprises a first supporting surface supporting the first larger surface of the second channel, a second supporting surface supporting the second larger surface of the second channel, and an intermediate portion connecting the first supporting surface to the second supporting surface.

An advantage of this vehicle heat exchanger tube is that it efficiently resists pressure and temperature strains, in particular at the inlet of the tube.

According to one embodiment the tube further comprises an inlet end portion and/or an outlet end portion at which the separating wall has been discontinued, giving the first and second channels contact with each other at the end portion, wherein the tube stiffener is at least partly received in the end portion. An advantage of this embodiment is that more space is provided for the stiffener, such that it may more efficiently reinforce the tube.

According to one embodiment, the inlet and/or outlet end portion has a length LEP, as measured from a distal end of the tube to the position where the separating wall starts, of 10-100 mm. Such a length LEP of the inlet and/or outlet end portion has been found to result in efficient heat transfer and robust design of tubes for vehicle heat exchangers.

According to one embodiment the joining portion of the tube stiffener is provided with a cut-out to receive at least a portion of the separating wall, wherein the first portion of the tube stiffener extends into the first channel at least partly into that part thereof where the first and second channels are separated from each other by the separating wall, and wherein the second portion of the tube stiffener extends into the second channel at least partly into that part thereof where the channels are separated from each other by the separating wall. An advantage of this embodiment is that the channels are reinforced more efficiently, since the stiffener provides a reinforcement and stiffening effect which overlaps with that position at which the separating wall is discontinued.

According to one embodiment the total length of the tube stiffener, as seen along the tube, is less than 20% of the total length of the tube. An advantage of this embodiment is that a minimum increase in the flow resistance is obtained, and still an efficient reinforcement.

According to one embodiment at least one of the large surfaces is provided with surface structures, and wherein the inlet end portion and/or the outlet end portion of the tube is essentially free from such surface structures. An advantage of this embodiment is that the stiffener may reinforce the tube more efficiently when the inlet and/or outlet portion in which the stiffener is located is essentially free from surface structures, at least partly due to the fact that the stiffener comes more efficiently into contact with the larger surfaces of the tube.

According to one embodiment the tube stiffener is made from a sheet metal, wherein a material thickness of the tube stiffener is less than 30% of the inner height, which is measured in a direction being parallel with the height of the separating wall, of the first and second channels. An advantage of this embodiment is that the tube stiffener provides efficient reinforcement without significantly increasing the flow resistance of the tube. According to one embodiment a material thickness MTS of the tube stiffener is 0.2 to 1.0 mm. An advantage of this embodiment is that efficient reinforcement of the tube is obtained, still with a relatively limited restriction to the flow through the tube.

According to one embodiment the first stiffening portion comprises an edge supporting surface supporting an edge surface connecting the first and second large surfaces of the first channel, and wherein the second stiffening portion comprises an edge supporting surface supporting an edge surface connecting the first and second large surfaces of the second channel. An advantage of this embodiment is that a further improved reinforcement of the tube is obtained.

According to one embodiment the tube stiffener is brazed to the first and second channels. An advantage of this embodiment is that an efficient mounting of the tube stiffener to the tube is obtained.

According to one embodiment at least one first inlet channel is formed between the first portion of the stiffener and one of the large surfaces of the first channel, and at least one second inlet channel is formed between the second portion of the stiffener and one of the large surfaces of the second channel. An advantage of this embodiment is that the fluid may flow through the tube at a low flow resistance.

According to one embodiment the tube stiffener is entirely received inside the tube. An advantage of this embodiment is that the tube takes relatively little space, and that the restriction to flow of fluid into or out from the tube is minimized. Furthermore, it will become even easier to mount a combination of tubes having a tube stiffener and tubes that do not have a tube stiffener to the same header plate of a vehicle heat exchanger.

According to one embodiment, each of the first and second separate fluid channels of the tube has an inner height HC of 1-6 mm, and an inner width WC of 5-30 mm. These measures have been found to provide for efficient transfer of heat in vehicle heat exchanger applications. Preferably, the inner height HC, which is measured in a direction being parallel with the height of the separating wall, is smaller than the internal width WC of the respective channel, and thereby the respective channel is a flat channel.

According to one embodiment, a total length LT of the vehicle heat exchanger tube may be in the range of 100 to 2000 mm. These lengths have been found to provide for efficient heat transfer and robust design of a vehicle heat exchanger.

According to one embodiment the vehicle heat exchanger tube comprises 2 to 5 separate and parallel fluid channels being separated from each other by respective separating walls, and a tube stiffener comprises a similar number of stiffening portions adapted to stiffen each of the respective channels. An advantage of this embodiment is that robust design and efficient heat transfer is obtained, without imposing an undue flow resistance.

A further object of the present invention is to provide a vehicle radiator that is efficient and has a robust design.

This object is achieved by means of a vehicle radiator that comprises at least one vehicle heat exchanger tube according to any of the embodiments described above.

An advantage of this vehicle radiator is that it is efficient, requires little space, and is robust to tough conditions with regard to, for example, temperature, fluid pressure, vibrations etc.

According to one embodiment the vehicle radiator comprises a plurality of vehicle heat exchanger tubes, wherein less than 50% of the total number of vehicle heat exchanger tubes of the vehicle radiator comprises tube stiffeners. An advantage of this vehicle radiator is that only those vehicle heat exchanger tubes that are exposed to the highest stresses, with regard to, for example, temperature and pressure, are tubes of the above mentioned type that comprise tube stiffeners, while those tubes of the vehicle radiator that are exposed to lower stresses are of a type having no stiffeners, or stiffeners of a type having a lower reinforcing effect. Thereby, those tubes that are exposed to lower stresses can be made cheaper, and with lower resistance to fluid flow, which makes the complete vehicle radiator cheaper and more energy efficient. More preferably, the vehicle radiator comprises a plurality of vehicle heat exchanger tubes, wherein 1.5 to 40% of the total number of vehicle heat exchanger tubes of the vehicle radiator comprises tube stiffeners. This number of vehicle heat exchanger tubes provided with tube stiffeners provides for suitable reinforcing to the vehicle radiator and still efficiency with regard to weight and cost in most vehicle radiator applications.

A further object of the present invention is to provide an efficient manner of manufacturing a vehicle heat exchanger tube.

This object is achieved by means of a method according to claim 13. An advantage of this method is that vehicle heat exchanger tubes with large resistance to temperature and fluid pressure can be efficiently manufactured.

According to one embodiment the method further comprises exposing, after the step of inserting the tube stiffener into the tube, the tube and the tube stiffener to a step of brazing to fix the tube stiffener to the tube. This provides for efficient fixing of the tube stiffener.

According to one embodiment the method comprises providing the tube with an inlet end portion and/or an outlet end portion in which the separating wall has been discontinued, providing the tube stiffener with a cut-out at its joining portion, and inserting the tube stiffener into the end portion of the tube until at least a portion of the discontinued separating wall is received in the cut-out of the tube stiffener. An advantage of this embodiment is that improved reinforcement can be obtained in that position where the separating wall is discontinued.

Further objects and features of the present invention will be apparent from the following detailed description and claims.

BRIEF DESCRIPTION OF THE DRAWINGS

The invention is described in more detail below with reference to the appended drawings in which.

DESCRIPTION OF PREFERRED EMBODIMENTS

Figure 1:
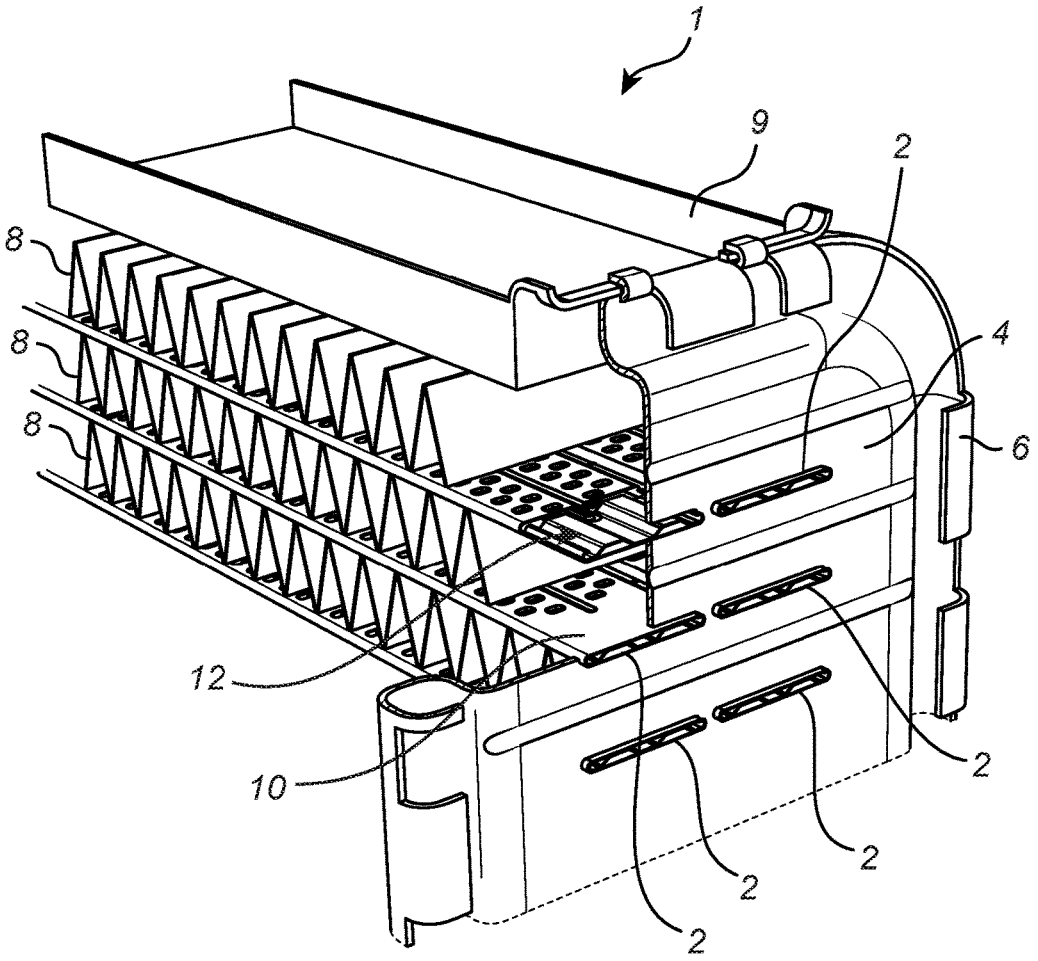
FIG. 1 is a three-dimensional view and illustrates a part of a vehicle heat exchanger core of a vehicle radiator.

FIG. 1 illustrates a vehicle radiator intended for ambient air cooling of a coolant, such as an engine cooling coolant, in a vehicle, such as a truck, lorry, excavator, etc., by allowing ambient air to pass through the vehicle heat exchanger to cool the coolant. In the illustration of FIG. 1 some parts of the vehicle radiator have been removed for the purpose of maintaining clarity of illustration. The vehicle radiator comprises a vehicle heat exchanger core 1 as shown in part in FIG. 1.

The heat exchanger core 1 comprises a number of vehicle heat exchanger tubes 2 through which a fluid, such as an engine cooling coolant, may be forwarded. Each tube 2 is of the multichannel type, i.e., each individual tube 2 has at least two separate channels as will be elaborated in more detail hereinafter. In the embodiment shown the tubes 2 are arranged in pairs, i.e. with two parallel tubes 2 on each "level".

The vehicle heat exchanger tubes 2 are mounted in a header plate 4. The header plate 4 may in turn be mounted to a heat exchanger tank (not shown for reasons of maintaining clarity of illustration) that supplies fluid to be cooled to the vehicle heat exchanger tubes 2. To this end, the header plate 4 comprises a mounting flange 6 connectable to the heat exchanger tank.

Between the tubes 2 heat exchanger fins 8 are arranged for improving the heat transfer between ambient air passing between the tubes 2 and the coolant being forwarded at the inside of the tubes 2. Optionally, a side plate 9 may be arranged outside of the outermost tube 2 or fin 8 to provide stability and physical protection to impact etc.

The vehicle heat exchanger tubes 2 are exposed to high pressures and high temperatures, in particular adjacent to the header plate 4 where the hot coolant enters the tubes 2. For this reason at least some of the tubes 2 are reinforced at their respective inlet end portions 10 by means of respective stiffeners 12 that will be described in more detail hereinafter.

Figure 2A:
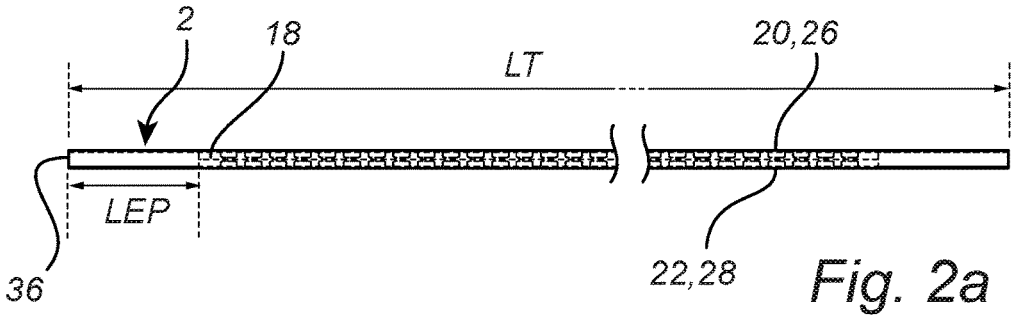
FIG. 2*a* is two-dimensional view and illustrates a vehicle heat exchanger tube as seen from the side thereof.
Figure 2B:
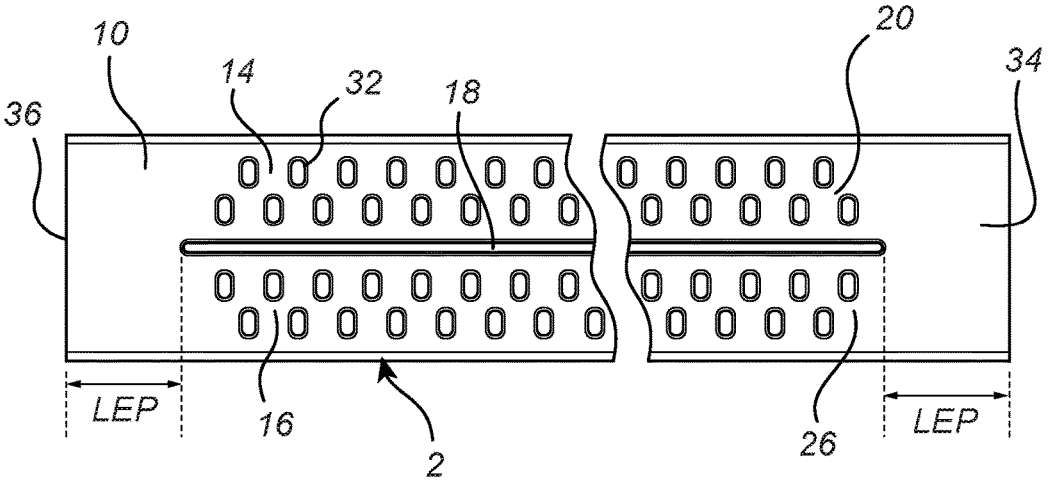
FIG. 2*b* is a two-dimensional view and illustrates the vehicle heat exchanger tube as seen from the top thereof.
Figure 2C:
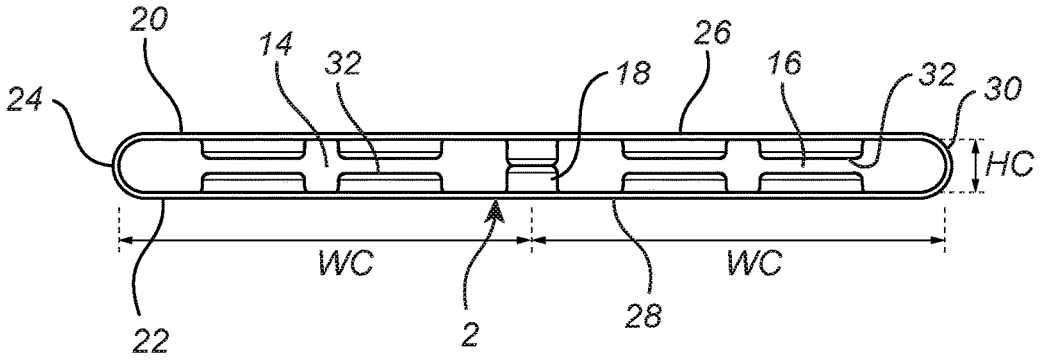
FIG. 2*c* is a two-dimensional view and illustrates the vehicle heat exchanger tube as seen from the end thereof.

FIG. 2*a* illustrates the vehicle heat exchanger tube 2 as seen from the side thereof, FIG. 2*b* illustrates the tube 2 as seen from the top thereof, and FIG. 2*c* illustrates the tube 2 as seen from the end thereof. The tube 2 has a first channel 14 and a second channel 16. A separating wall 18 separates the two channels 14, 16 from each other. Each channel 14, 16 has, as best shown in FIG. 2*c*, an inner height HC, which is measured in a direction being parallel with the height of the separating wall 18, which is smaller than its internal width WC, and thereby the respective channel 14, 16 can be considered to be a flat channel. According to one example, the inner height HC is 1-6 mm, and the inner width WC is 5-30 mm. The total length LT, shown in FIG. 2*a*, of the tube 2 may, depending on the application, typically be 100 to 2000 mm.

The first channel 14 has a first large surface 20 and an opposing second large surface 22 each having a width being similar to the inner width WC. The large surfaces 20, 22 are held together by the separating wall 18 and by an edge surface 24. Similarly, the second channel 16 has a first large surface 26 and an opposing second large surface 28 each having a width being similar to the inner width WC. The large surfaces 26, 28 are held together by the separating wall 18 and by an edge surface 30. One or more of the large surfaces 20, 22, 26, 28 may be provided with surface structures, for example dimples 32, for enhancing turbulence.

The tube 2 has the inlet end portion 10 and an outlet end portion 34. At the end portion 10 the separating wall 18 has been discontinued, meaning that the two channels 14, 16 have contact with each other at the end portion 10. Furthermore, surface structures, such as dimples 32, are, according to one embodiment, discontinued at the end portion 10, meaning that the large surfaces 20, 22, 26, 28 are essentially flat at the end portion 10.

The inlet end portion 10 has a length LEP, as measured from a distal end 36 of the tube 2 to the position where the separating wall 18 starts, which length LEP may be, for example, 10-100 mm. The outlet end portion 34 may have a length LEP and a design which is similar to that of the inlet end portion 10.

Figure 3A:
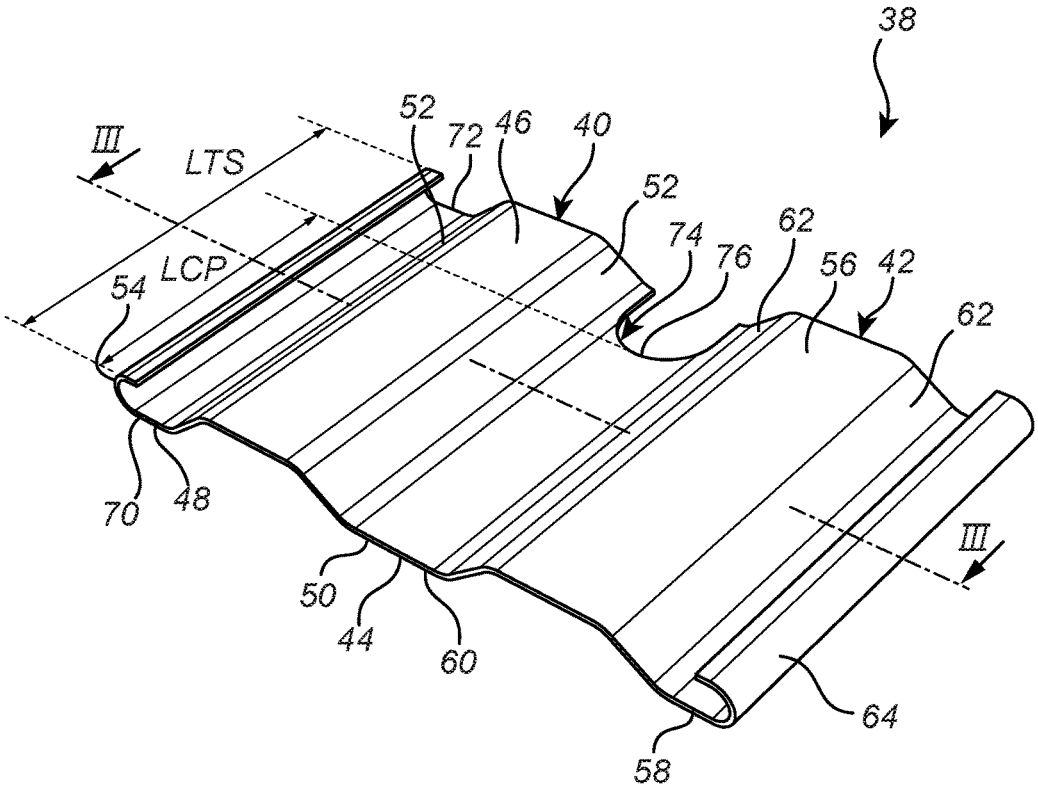
FIG. 3*a* is three-dimensional view and illustrates a tube stiffener according to a first embodiment.
Figure 3B:
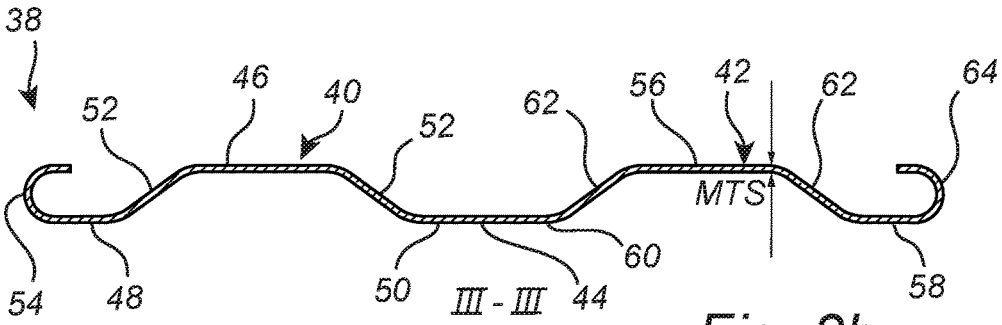
FIG. 3*b* is a two-dimensional view and illustrates the tube stiffener as seen in cross-section, along the arrows III-III of FIG. 3*a*.

FIG. 3*a* illustrates, as an example embodiment of the stiffener 12 shown in FIG. 1, a tube stiffener 38 in a three-dimensional perspective, and FIG. 3*b* illustrates the tube stiffener 38 as seen in cross-section. The tube stiffener 38 comprises a first stiffening portion 40 adapted for stiffening the first channel 14 of the tube 2, and a second stiffening portion 42 adapted for stiffening the second channel 16 of the tube 2. The first and second stiffening portions 40, 42 are joined to each other at a central joining portion 44. In the embodiment shown in FIGS. 3*a* and 3*b* the stiffener 38 is in fact an integral unit including the two stiffening portions 40, 42 and made from a single piece of sheet metal, for example aluminium, such as a tinplate of aluminium. The material thickness MTS of the stiffener 38 is, typically, 0.2 to 1.0 mm.

The first stiffening portion 40 comprises a first supporting surface 46 adapted to be in contact with the first larger surface 20 of the first channel 14 of the tube 2 shown in FIGS. 2*a-c*. Returning to FIGS. 3*a-b*, second and third supporting surfaces 48, 50 are arranged on opposite sides of the first supporting surface 46 and are adapted to be in contact with the second larger surface 22 of the first channel 14. The second and third supporting surfaces 48, 50 are connected to the first supporting surface 46 via intermediate portions 52. Furthermore, an edge supporting surface 54 is connected to the second supporting surface 48.

Similarly, the second stiffening portion 42 comprises a first supporting surface 56 adapted to be in contact with the first larger surface 26 of the second channel 16 of the tube 2, and second and third supporting surfaces 58, 60 arranged on opposite sides of the first supporting surface 56 and adapted to be in contact with the second larger surface 28 of the second channel 16. The second and third supporting surfaces 58, 60 are connected to the first supporting surface 56 via intermediate portions 62, and an edge supporting surface 64 is connected to the second supporting surface 58.

At the central joining portion 44 the third supporting surface 50 of the first stiffening portion 40 is connected to the third supporting surface 60 of the second stiffening portion 42.

A total length LTS of the stiffener 38, as measured from an outer end 70 of the stiffener 38 to an inner end 72, is longer than the length LEP of the inlet end portion 10 as described hereinbefore with reference to FIGS. 2*a* and 2*b*. Returning to FIG. 3*a*, the joining portion 44 is provided with a cut-out 74. A central joining portion length LCP of the central joining portion 44, as measured from the outer end 70 of the stiffener 38 to a bottom 76 of the cut-out 74, is equal to or shorter than the length LEP of the inlet end portion 10 as described hereinbefore with reference to FIGS. 2*a* and 2*b*.

The total length LTS of the stiffener 38, as seen along the tube 2, is typically less than 20% of the total length LT of the tube 2, as shown in FIG. 2*a*. Thereby, a minimum increase in the coolant flow resistance is obtained.

Figure 4A:
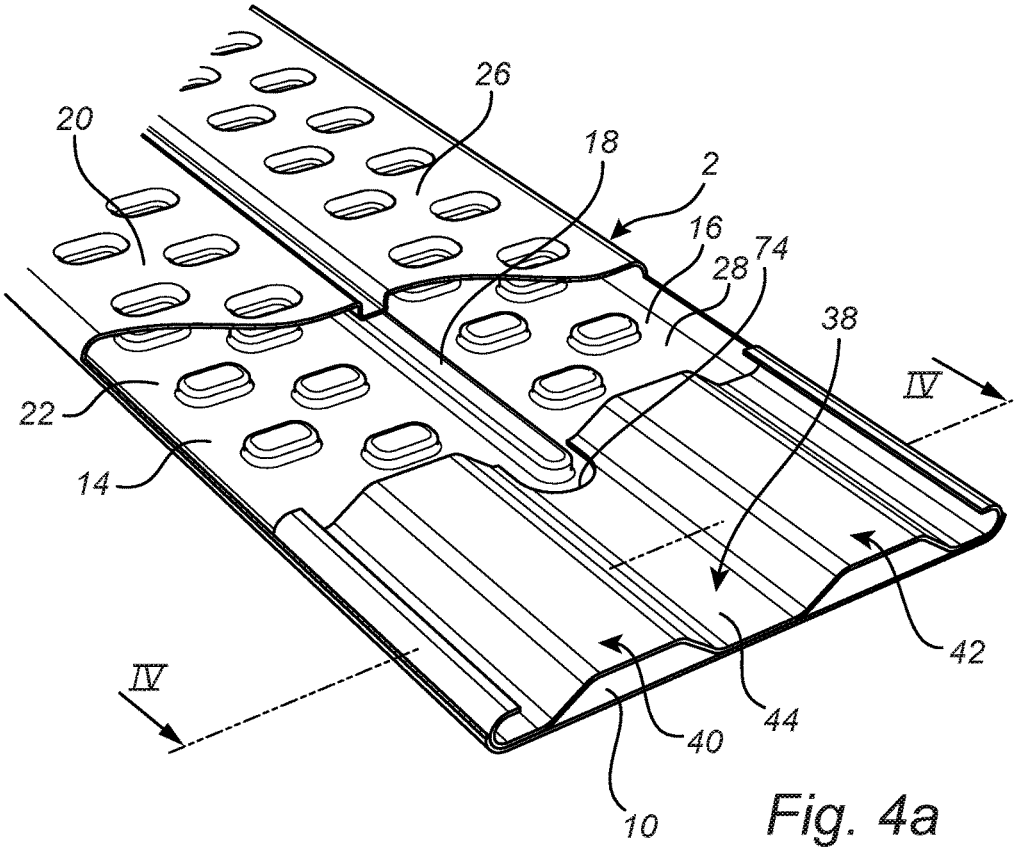
FIG. 4*a* is a three-dimensional view and illustrates the tube stiffener mounted in the vehicle heat exchanger tube.
Figure 4B:
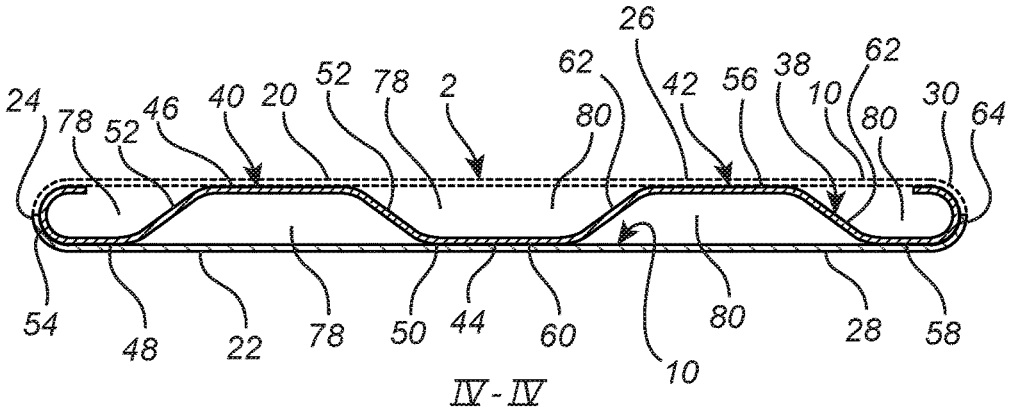
FIG. 4*b* is a two-dimensional view and illustrates the tube stiffener mounted in the tube as seen in cross-section, along the arrows IV-IV of FIG. 4*a*.

FIG. 4*a* illustrates the tube stiffener 38 mounted in the inlet end portion 10 of the vehicle heat exchanger tube 2, and FIG. 4*b* is a cross-section, as seen along the arrows IV-IV of FIG. 4*a*. For reasons of making the illustration clearer some portions of the first larger surfaces 20, 26 have been removed in the illustration of FIG. 4*a*.

As best illustrated in FIG. 4*b*, the first supporting surface 46 of the first portion 40 of the stiffener 38 supports the first larger surface 20 of the first channel 14, and the second and third supporting surfaces 48, 50 supports the second larger surface 22 of the first channel 14. The edge supporting surface 54 supports the edge surface 24. The respective supporting surface 46, 48, 50, 54 is at least partly fixed to its respective surface 20, 22, 24 by means of, for example, being brazed thereto.

Similarly, the first supporting surface 56 of the second portion 42 of the stiffener 38 supports the first larger surface 26 of the second channel 16, and the second and third supporting surfaces 58, 60 supports the second larger surface 28 of the second channel 16. The edge supporting surface 64 supports the edge surface 30. The respective supporting surface 56, 58, 60, 64 is at least partly fixed to its respective surface 26, 28, 30 by means of, for example, being brazed thereto.

The intermediate portions 52 of the first portion 40 of the stiffener 38 prevents the first supporting surface 46 from being displaced from the second and third supporting surfaces 48, 50. As the first supporting surface 46 is fixed to the first large surface 20 and the second and third supporting surfaces 48 and 50 are fixed to the second large surface 22, those first and second large surfaces 20, 22 are prevented from being displaced from each other, under, for example, the pressure exerted from the medium at the inside of the first channel 14. Also the edge surface 24 is supported. In essence, the first channel 14 is prevented from being expanded under the influence of the internal pressure. Thus, the stiffener 38 adds strength and support to the first channel 14. In a corresponding manner, the stiffener 38 also adds strength and support to the second channel 16.

As is best illustrated in FIG. 4*a*, the separating wall 18 of the tube 2 is at least partly received in the cut-out 74 of the stiffener 38, as the total length LTS, illustrated in FIG. 3*a*, of the stiffener 38 is longer than the length LEP, illustrated in FIGS. 2*a* and 2*b*, of the inlet end portion 10, while the central joining portion length LCP, illustrated in FIG. 3*a*, is equal to or shorter than the length LEP, illustrated in FIGS. 2*a* and 2*b*, of the inlet end portion 10. The first portion 40 of the stiffener 38 will thereby extend into the first channel 14 at least partly into that part thereof where the first and second channels 14, 16 are separated from each other by the separating wall 18, and the second portion 42 of the stiffener 38 will extend into the second channel 16 at least partly into that part thereof where the channels 14, 16 are separated from each other by the separating wall 18. The transition area between the inlet end portion 10 and the end of the separating wall 18 is a sensitive position from a mechanical perspective, and this transition area is supported by the first and second portions 40, 42 of the stiffener 38 extending beyond that transition area and into the separated portions of the channels 14, 16.

As best illustrated in FIG. 4*b*, first inlet channels 78 are formed between the first portion 40 of the stiffener 38 and the large surfaces 20, 22 of the first channel 14, and second inlet channels 80 are formed between the second portion 42 of the stiffener 38 and the large surfaces 26, 28 of the second channel 16. Additionally, the material thickness MTS, best shown in FIG. 3*b*, of the stiffener 38, is typically less than 30% of the inner height HC, best shown in FIG. 2*c*, of the respective channel 14, 16. Thereby, a fluid may enter the tube 2 with very little obstruction from the stiffener 38.

In FIGS. 4*a*-*b* it is described how a stiffener 38 is inserted in the inlet end portion 10 of the tube 2. It will be appreciated that a stiffener 38 may also, either as alternative to inserting a stiffener 38 in the inlet end portion 10, or in combination therewith, be inserted in the outlet end portion 34, shown in FIG. 2*b*, in accordance with principles that are similar to those disclosed in FIGS. 4*a*-4*b*. Hence, the tube 2 could be provided with a stiffener 38 inserted in the inlet end portion 10, in the outlet end portion 34, or both.

Hereinbefore, it has been described that the vehicle heat exchanger tube 2 comprises a first fluid channel 14 and a second fluid channel 16, and that the tube stiffener 38 has a first stiffening portion 40 stiffening the first channel 14 of the tube 2, and a second stiffening portion 42 stiffening the second channel 16 of the tube 2. It will be appreciated that the vehicle heat exchanger tube according to an alternative embodiment could comprise further parallel fluid channels, for example a third fluid channel which is arranged adjacent to the second fluid channel 16.

Figure 5:
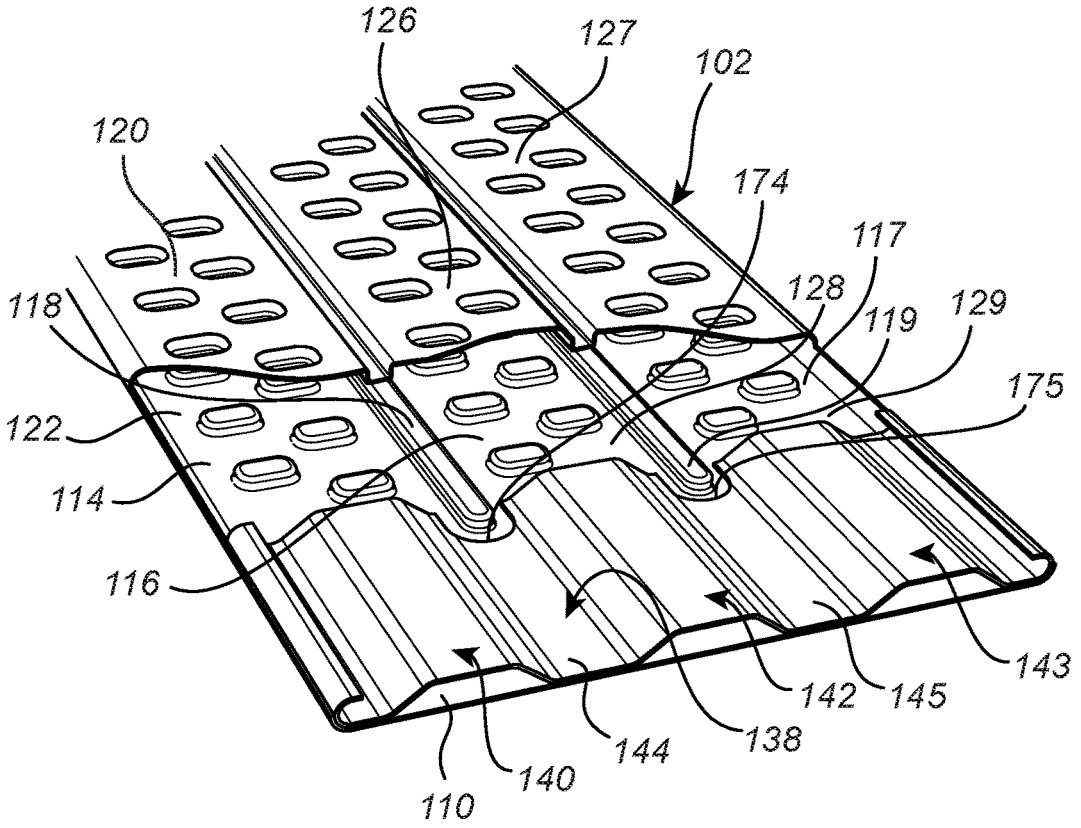
FIG. 5 is a three-dimensional view and illustrates a tube stiffener and a vehicle heat exchanger tube according to an alternative embodiment.

FIG. 5 illustrates such an alternative vehicle heat exchanger tube 102 which is similar to the heat exchanger tube 2 described hereinabove, but which has a first channel 114, a second channel 116, and a third channel 117 that are all parallel to each other, wherein the second channel 116 is a central channel located between the first and third channels 114, 117. A first separating wall 118 separates the first and second channels 114, 116 from each other, and a second separating wall 119 separates the second and third channels 116, 117 from each other.

A tube stiffener 138 is inserted in an inlet end portion 110 of the tube 102. The tube stiffener 138 is rather similar to the tube stiffener 38 but comprises a first stiffening portion 140 adapted for stiffening the first channel 114 of the tube 102, a second stiffening portion 142 adapted for stiffening the second channel 116 of the tube 102, and a third stiffening portion 143 adapted for stiffening the third channel 117 of the tube 102. The respective stiffening portions 140, 142, 143 may have a similar design as the stiffening portions 40, 42 described in detail hereinabove with reference to FIGS. 3*a* and 3*b*. Returning to FIG. 5, the first and second stiffening portions 140, 142 are joined to each other at a first joining portion 144, and the second and third stiffening portions 142, 143 are joined to each other at a second joining portion 145.

The first stiffening portion 140 supports larger surfaces 120, 122 of the first channel 114 of the tube 102 according to principles similar to those described hereinabove with reference to FIG. 4*b*. In a similar manner the second stiffening portion 142 supports larger surfaces 126, 128 of the second channel 116 of the tube 102, and the third stiffening portion 143 supports larger surfaces 127, 129 of the third channel 117 of the tube 102.

The first joining portion 144 of the stiffener 138 is provided with a first cut-out 174, and the second joining portion 145 is provided with a second cut-out 175. When the stiffener 138 has been inserted in the inlet end portion 110 of the tube 102 the first separating wall 118 of the tube 102 is at least partly received in the first cut-out 174 of the stiffener 138, and the second separating wall 119 is at least partly received in the second cut-out 175 of the stiffener 138. The first portion 140 of the stiffener 138 will thereby extend into the first channel 114 at least partly into that part thereof where the first and second channels 114, 116 are separated from each other by the first separating wall 118, the second portion 142 of the stiffener 138 will extend into the second channel 116 at least partly into that part thereof where the channels 114, 116, 117 are separated from each other by the first and second separating walls 118, 119, and the third portion 143 of the stiffener 138 will extend into the third channel 117 at least partly into that part thereof where the second and third channels 116, 117 are separated from each other by the second separating wall 119. Thereby the sensitive transition area between the inlet end portion 110 and the ends of the separating walls 118, 119 is efficiently supported by the first, second and third portions 140, 142, 143 of the stiffener 138 extending beyond that transition area and into the separated portions of the channels 114, 116, 117.

It will be appreciated that numerous variants of the embodiments described above are possible within the scope of the appended claims.

Hence, a vehicle heat exchanger tube may comprise two or more separate fluid channels extending along the tube 2 and being parallel with each other and being separated from each other by respective separating walls. Most preferably, the vehicle heat exchanger tube comprises 2 to 5 separate and parallel fluid channels being separated from each other by respective separating walls, and a tube stiffener preferably comprises the same number of stiffening portions and is adapted to stiffen each of the respective channels.

To summarize, a vehicle heat exchanger tube (2) comprises at least a first and a second separate fluid channel (14, 16). A tube stiffener (38) has a first stiffening portion (40) stiffening the first channel (14) of the tube (2), and a second stiffening portion (42) stiffening the second channel (16) of the tube (2). The first stiffening portion (40) comprises a first supporting surface (46) supporting the first larger surface (20) of the first channel (14), and a second supporting surface (48) supporting the second larger surface (22) of the first channel (14). The second stiffening portion (42) comprises a first supporting surface (56) supporting the first larger surface (26) of the second channel (16), and a second supporting surface (58) supporting the second larger surface (28) of the second channel (16).

The invention claimed is:

1. A vehicle heat exchanger tube comprising an internal reinforcement structure, the vehicle heat exchanger tube comprising at least a first and a second separate fluid channel extending along the tube and being parallel with each other and being separated from each other by at least one separating wall extending along at least a portion of the tube, each fluid channel having an inner height and an inner width, the inner height measured in a direction being parallel with a height of the separating wall, the inner height being smaller than the inner width, the first channel having a first large surface, and an opposing second large surface, the second channel having a first large surface, and an opposing second large surface, wherein the internal reinforcement structure is a tube stiffener having a first stiffening portion stiffening the first channel of the tube, and a second stiffening portion stiffening the second channel of the tube, wherein the first and second stiffening portions of the tube stiffener are joined to each other at a joining portion, wherein the first stiffening portion comprises a first supporting surface supporting the first large surface of the first channel, a second supporting surface supporting the second large surface of the first channel, and an intermediate portion connecting the first supporting surface to the second supporting surface, and wherein the second stiffening portion comprises a first supporting surface supporting the first large surface of the second channel, a second supporting surface supporting the second large surface of the second channel, and an intermediate portion connecting the first supporting surface to the second supporting surface, wherein the tube comprises an inlet or outlet end portion at which the separating wall has been discontinued such that the first and second channels combine within the tube at said end portion, wherein the tube stiffener is at least partly received in said end portion such that the joining portion of the tube stiffener is arranged to be inserted into the inlet or outlet end portion at which the separating wall has been discontinued, and wherein the joining portion of the tube stiffener is provided with a cut-out that receives at least a portion of the separating wall, and wherein the first stiffening portion of the tube stiffener extends into the first channel at least partly into the tube where the first and second channels are separated from each other by the separating wall, and wherein the second stiffening portion of the tube stiffener extends into the second channel at least partly into the tube where the channels are separated from each other by the separating wall.

2. A tube according to claim 1, wherein at least one of the large surfaces is provided with surface structures, and wherein said inlet or outlet end portion of the tube is essentially free from such surface structures.

3. A tube according to claim 1, wherein the total length of the tube stiffener, as seen along the tube, is less than 20% of the total length of the tube.

4. A tube according to claim 1, wherein the tube stiffener is made from a sheet metal, and wherein a material thickness of the tube stiffener is less than 30% of the inner height, which is measured in a direction being parallel with the height of the separating wall, of the first and second channels.

5. A tube according to claim 1, wherein the first stiffening portion comprises an edge supporting surface supporting an edge surface connecting the first and second large surfaces of the first channel, and wherein the second stiffening portion comprises an edge supporting surface supporting an edge surface connecting the first and second large surfaces of the second channel.

6. A tube according to claim 1, wherein the tube stiffener is brazed to the first and second channels.

7. A tube according to claim 1, wherein at least one first inlet channel is formed between the first stiffening portion of the tube stiffener and one of the large surfaces of the first channel, and at least one second inlet channel is formed between the second stiffening portion of the tube stiffener and one of the large surfaces of the second channel.

8. A tube according to claim 1, wherein the tube stiffener is entirely received inside the tube.

9. A vehicle radiator, comprising at least one vehicle heat exchanger tube according to claim 1.

10. A vehicle radiator according to claim 9, the vehicle radiator comprising a plurality of vehicle heat exchanger tubes, wherein less than 50% of the total number of vehicle heat exchanger tubes comprise tube stiffeners.

11. A method of forming a vehicle heat exchanger tube, the method comprising:

forming a tube comprising at least a first and a second separate fluid channel extending along the tube and being parallel with each other and being separated from each other by at least one separating wall extending along at least a portion of the tube, each fluid channel having an inner height and an inner width, the inner height measured in a direction being parallel with a height of the separating wall, the inner height being smaller than the inner width, the first channel having a first large surface, and an opposing second large surface, the second channel having a first large surface, and an opposing second large surface, wherein the tube is provided with an inlet end portion or an outlet end portion in which the separating wall has been discontinued which allows the first and second separate fluid channels to be combined within the tube, forming a tube stiffener having a first stiffening portion intended for stiffening the first channel of the tube, and a second stiffening portion intended for stiffening the second channel of the tube, wherein the first and second stiffening portions of the tube stiffener are joined to each other at a joining portion, the joining portion of the tube stiffener including a cut-out configured to receive at least a portion of the separating wall, and inserting the joining portion of the tube stiffener into the inlet end portion or the outlet end portion in which the separating wall has been discontinued, wherein a first supporting surface of the first stiffening portion extends into the first channel at least partly into the tube where the first and second channels are separated from each other by the separating wall to support the first large surface of the first channel, and a second supporting surface of the first stiffening portion extends into the first channel at least partly into the tube where the first and second channels are separated from each other by the separating wall to support the second large surface of the first channel, and wherein a first supporting surface of the second stiffening portion extends into the second channel at least partly into the tube where the first and second channels are separated from each other by the separating wall to support the first large surface of the second channel, and a second supporting surface of the second stiffening portion extends into the second channel at least partly into the tube where the first and second channels are separated from each other by the separating wall to support the second large surface of the second channel.

12. A method according to claim 11, further comprising exposing, after inserting the tube stiffener into the tube, the tube and the tube stiffener to a brazing to fix the tube stiffener to the tube.

* * * * *